US009321568B2

(12) United States Patent
Gelardi et al.

(10) Patent No.: US 9,321,568 B2
(45) Date of Patent: Apr. 26, 2016

(54) DISPENSING CONTAINER

(75) Inventors: John A. Gelardi, Wake Forest, NC (US); Caleb S. Loftin, Raleigh, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 1016 days.

(21) Appl. No.: 12/883,700

(22) Filed: Sep. 16, 2010

(65) Prior Publication Data

US 2011/0000931 A1 Jan. 6, 2011

Related U.S. Application Data

(62) Division of application No. 12/109,528, filed on Apr. 25, 2008, now Pat. No. 7,946,450.

(51) Int. Cl.

| | |
|---|---|
| ***B65D 83/08*** | (2006.01) |
| ***B65D 83/00*** | (2006.01) |
| ***B65D 83/04*** | (2006.01) |
| ***B65D 50/04*** | (2006.01) |

(52) U.S. Cl.

CPC ..... *B65D 50/046* (2013.01); *B65D 83/0418* (2013.01); *B65D 2583/0468* (2013.01)

(58) Field of Classification Search

USPC ..... 221/154, 246, 268, 311

See application file for complete search history.

(56) References Cited

U.S. PATENT DOCUMENTS

| | | | |
|---|---|---|---|
| 194,197 | A | 8/1877 | Villaret |
| 533,044 | A | 1/1895 | Bingham |
| 889,568 | A | 6/1908 | Albrecht |
| 1,701,565 | A | 2/1929 | Hammett |
| 1,837,722 | A | 12/1931 | McAtree |
| 1,963,025 | A | 6/1932 | Mackie |
| 2,090,530 | A | 8/1937 | Guffey et al. |
| 2,645,336 | A | 7/1953 | Waber |
| 2,653,706 | A | 9/1953 | Aggson |
| 2,686,627 | A | 8/1954 | McElwee |
| 2,769,565 | A | 11/1956 | Sottile |
| 3,563,412 | A | 2/1971 | James |
| 3,696,917 | A | 10/1972 | Levi |
| 3,761,009 | A | 9/1973 | Resenburg |

(Continued)

FOREIGN PATENT DOCUMENTS

| | | | |
|---|---|---|---|
| CH | 180218 | A | 10/1935 |
| DE | 7427559 | | 12/1974 |

(Continued)

*Primary Examiner* — Gene Crawford
*Assistant Examiner* — Kelvin L Randall, Jr.
(74) *Attorney, Agent, or Firm* — Womble Carlyle Sandridge & Rice LLP

(57) ABSTRACT

A container for dispensing a product is provided, the container including an outer casing body having a cavity; a dispensing tray adapted for sliding movement within the cavity of the outer casing body between a closed and locked position and a dispensing position, the dispensing tray having an internal storage compartment for storage of a plurality of units of a product to be dispensed, a dispensing window, and a stop for engaging the outer casing body to prevent removal of the dispensing tray from the cavity; and a locking mechanism for releasably locking the dispensing tray in the cavity, the locking mechanism including protrusions projecting from the outer casing body into the cavity and positioned adjacent to a moveable flap formed in the outer casing body, and recesses carried by the dispensing tray and positioned to engage the protrusions when the dispensing tray is in the closed and locked position.

24 Claims, 13 Drawing Sheets

(56) References Cited

U.S. PATENT DOCUMENTS

| | | | | |
|---|---|---|---|---|
| 3,782,584 | A | 1/1974 | Swenson et al. | |
| 3,895,737 | A | 7/1975 | Phillips | |
| B536,923 | I5 | 3/1976 | Mayled | |
| 4,057,145 | A | 11/1977 | Wray et al. | |
| 4,076,117 | A * | 2/1978 | Wisdom et al. | 206/106 |
| 4,113,098 | A | 9/1978 | Howard | |
| 4,154,365 | A | 5/1979 | Lorca | |
| 4,275,819 | A | 6/1981 | Perez | |
| 4,278,185 | A | 7/1981 | Perez | |
| 4,284,204 | A | 8/1981 | Carey, Jr. | |
| 4,364,488 | A | 12/1982 | Anjou | |
| 4,437,579 | A | 3/1984 | Obland | |
| 4,561,544 | A | 12/1985 | Reeve | |
| 4,572,376 | A | 2/1986 | Wrennall | |
| 4,611,727 | A | 9/1986 | Graff | |
| 4,705,165 | A | 11/1987 | Thieke | |
| 4,741,435 | A | 5/1988 | Clarke | |
| 4,939,860 | A | 7/1990 | Ackeret | |
| 4,967,909 | A | 11/1990 | McKibben | |
| 5,080,222 | A | 1/1992 | McNary | |
| 5,082,137 | A | 1/1992 | Weinstein | |
| 5,108,006 | A | 4/1992 | Tieke et al. | |
| 5,174,471 | A | 12/1992 | Kozlowski et al. | |
| 5,275,291 | A | 1/1994 | Sledge | |
| 5,657,901 | A | 8/1997 | Farside | |
| 5,782,359 | A | 7/1998 | McAllister et al. | |
| 5,816,441 | A | 10/1998 | Farside | |
| 5,897,025 | A | 4/1999 | Flewitt et al. | |
| 5,909,822 | A | 6/1999 | George et al. | |
| 5,915,560 | A | 6/1999 | George et al. | |
| 6,050,449 | A * | 4/2000 | Kanj | 221/232 |
| 6,131,765 | A | 10/2000 | Barry et al. | |
| 6,155,454 | A | 12/2000 | George et al. | |
| 6,267,265 | B1 | 7/2001 | Issa | |
| 6,382,460 | B1 | 5/2002 | Gonzalez | |
| 6,460,693 | B1 | 10/2002 | Harrold | |
| 6,527,138 | B2 | 3/2003 | Pawlo et al. | |
| 6,564,967 | B1 | 5/2003 | Stringfield et al. | |
| 6,641,031 | B2 | 11/2003 | Evans et al. | |
| 6,758,338 | B2 | 7/2004 | Lien | |
| 6,863,175 | B2 | 3/2005 | Gelardi | |
| 6,913,149 | B2 | 7/2005 | Gelardi et al. | |
| 6,976,576 | B2 | 12/2005 | Intini | |
| 7,159,720 | B2 | 1/2007 | Pearson | |
| 7,216,776 | B2 | 5/2007 | Gelardi | |
| 7,287,666 | B2 | 10/2007 | De Laforcade | |
| 7,320,413 | B2 | 1/2008 | Fusi | |
| 7,533,785 | B2 | 5/2009 | Smith | |
| 7,565,969 | B2 | 7/2009 | He | |
| 7,584,843 | B2 * | 9/2009 | Kutsch et al. | 206/267 |
| 7,708,142 | B2 * | 5/2010 | Ehrlund | 206/528 |
| 7,740,132 | B2 | 6/2010 | Oono et al. | |
| 7,757,843 | B2 | 7/2010 | Katsis | |
| 7,946,450 | B2 | 5/2011 | Gelardi et al. | |
| 2002/0175195 | A1 | 11/2002 | Cole | |
| 2003/0106900 | A1 | 6/2003 | Storz | |
| 2004/0055903 | A1 * | 3/2004 | Nishimura | 206/1.5 |
| 2004/0074917 | A1 | 4/2004 | McHutchinson | |
| 2004/0217024 | A1 | 11/2004 | Arnarp et al. | |
| 2005/0011773 | A1 | 1/2005 | Intini | |
| 2005/0173272 | A1 | 8/2005 | Lemmons, IV | |
| 2005/0183981 | A1 * | 8/2005 | Gelardi | 206/531 |
| 2005/0205598 | A1 | 9/2005 | Gelardi | |
| 2006/0060480 | A1 | 3/2006 | Budd | |
| 2006/0118589 | A1 | 6/2006 | Arnarp et al. | |
| 2006/0124658 | A1 | 6/2006 | Coe et al. | |
| 2006/0243611 | A1 | 11/2006 | Wu | |
| 2007/0068960 | A1 | 3/2007 | Valentine et al. | |
| 2007/0131704 | A1 | 6/2007 | Ahedo | |
| 2007/0163911 | A1 | 7/2007 | Gelardi | |
| 2007/0246382 | A1 | 10/2007 | He | |
| 2007/0246383 | A1 | 10/2007 | He | |
| 2007/0277299 | A1 | 12/2007 | Kroon | |
| 2008/0029110 | A1 | 2/2008 | Dube et al. | |
| 2008/0029116 | A1 | 2/2008 | Robinson et al. | |
| 2008/0142535 | A1 | 6/2008 | Adler et al. | |
| 2009/0200332 | A1 | 8/2009 | Intini | |
| 2009/0223989 | A1 | 9/2009 | Gelardi | |
| 2010/0084424 | A1 | 4/2010 | Gelardi | |
| 2010/0133140 | A1 | 6/2010 | Bailey | |

FOREIGN PATENT DOCUMENTS

| | | |
|---|---|---|
| FR | 769822 | 9/1934 |
| GB | 2 042 476 | 9/1980 |
| WO | WO 99/48391 A | 9/1999 |
| WO | WO 2004/035404 A1 | 4/2004 |
| WO | WO-2004/037657 | 5/2004 |
| WO | WO 2004/037657 A2 | 5/2004 |
| WO | WO 2005/016036 A1 | 2/2005 |
| WO | WO 2005/028316 A2 | 3/2005 |
| WO | WO 2005/030606 A1 | 4/2005 |
| WO | WO 2005/035390 A1 | 4/2005 |
| WO | WO 2007/017761 A2 | 2/2007 |
| WO | WO 2007/067953 A2 | 6/2007 |
| WO | WO 2007/070867 A2 | 6/2007 |
| WO | WO 2008/070032 A2 | 6/2008 |
| WO | WO 2009/055547 A1 | 4/2009 |

* cited by examiner

DISPENSING CONTAINER

CROSS-REFERENCE TO RELATED APPLICATIONS

This application is a divisional of U.S. patent application Ser. No. 12/109,528, filed Apr. 25, 2008 now U.S. Pat. No. 7,946,450, which is hereby incorporated herein in its entirety.

FIELD OF THE INVENTION

The present invention relates to containers and methods of use thereof. More particularly, the invention relates to containers that provide dispensing or dosing of the stored product.

BACKGROUND OF THE INVENTION

Various types of containers for dispensing solid objects, particularly solid products intended for human consumption, are known in the art. Such containers are often characterized by a hand-held size that can be easily stored and transported. Exemplary consumable products that are often packaged in such containers include pharmaceutical compositions, oral tobacco products, snacks, mints, gums, breath strips, candy, and the like.

Certain consumable products, such as pharmaceutical products, require containers having a certain level of child resistance. Traditionally, pills have been packaged in a bottle having a cap that can only be removed by applying downward pressure while twisting the cap. However, this type of child resistance has certain disadvantages. For example, if a child does manage to open the bottle, immediate access is provided to the entire contents of the bottle. Further, if an adult user fails to place the cap in the properly secured position, there is no secondary mechanism for preventing access by a child.

In addition to child resistance, another desirable feature for certain containers is the ability to dispense a metered amount of a product. In other words, it can be highly desirable for the container to control dispensing such that only a defined number of stored product units, such as only a single unit, is dispensed each time the container is opened. Metered distribution of a product can be advantageous as a further level of child resistance as it prevents unrestricted access to the entire contents of the container, and as a means to improve sanitation because such a container negates the need to touch numerous units within the container in order to obtain a single desired unit.

Exemplary containers that provide a locking mechanism for enhancing child-resistance of a container can be found, for example, in U.S. Pat. No. 6,863,175 to Gelardi; U.S. Pat. No. 6,913,149 to Gelardi et al.; U.S. Pat. No. 6,976,576 to Intini; and U.S. Pat. No. 7,216,776 to Gelardi, which are incorporated herein by reference in their entirety.

There remains a need in the art for a container for storing and dispensing a product capable of combining various advantageous features, such as child resistance, metered dispensing, and convenient size.

BRIEF SUMMARY OF THE INVENTION

The present invention provides a container that, in certain embodiments, combines child-resistance with metered dispensing, and which can be provided in a convenient handheld size. The type and form of the product to be stored and dispensed can vary, but sheet or film shaped products arranged in a stacked formation are particularly well-suited for use with the containers of the invention. The stored product can be, for example, pharmaceutical products, smoking products, smokeless tobacco products, snack products, or confectionary products (e.g., candies, mints, gums).

In one aspect, the invention provides a dispensing container comprising an outer casing body having a cavity therein and an open end; a dispensing tray adapted for sliding movement within the cavity of the outer casing body between a closed and locked position and a dispensing position, the dispensing tray comprising an internal storage compartment adapted for storage of a plurality of units of a product to be dispensed, a dispensing window through which a stored unit of product is accessible when the dispensing tray is in the dispensing position, and a stop adapted for engaging the outer casing body to prevent removal of the dispensing tray from the cavity of the outer casing body; and a locking mechanism adapted for releasably locking the dispensing tray in the closed and locked position, the locking mechanism comprising one or more protrusions projecting from the outer casing body into the cavity and positioned adjacent to a moveable flap formed in the outer casing body, and one or more recesses carried by the dispensing tray and operatively positioned to engage the one or more protrusions when the dispensing tray is in the closed and locked position, such that depressing the flap will effect separation of the one or more protrusions from the one or more recesses and allow sliding movement of the dispensing tray within the outer casing body.

In one embodiment, the locking mechanism comprises two protrusions, one protrusion positioned on either side of the moveable flap, and two recesses formed in the dispensing tray adapted to engage the two protrusions. The protrusions of the outer casing body can comprise a slanted surface positioned to engage the dispensing tray as the dispensing tray moves toward the closed and locked position. The recesses of the dispensing tray can be positioned within a moveable flap configured to deflect away from the corresponding protrusions when the moveable flap of the outer casing body is depressed.

The moveable flap of the outer casing body can comprise one or more stiffening ribs projecting into the cavity of the outer casing body. The dispensing container can further comprise a moveable flap in a surface of the dispensing tray opposite the dispensing window for deflection of a unit of product toward the dispensing window.

In one preferred embodiment, the dispensing container of the invention comprises:

an outer casing body having a cavity therein and an open end, the outer casing body comprising a moveable flap accessible from the exterior of the container and one or more protrusions projecting from the outer casing body into the cavity and positioned adjacent to the moveable flap; and a dispensing tray adapted for sliding movement within the cavity of the outer casing body between a closed and locked position and a dispensing position, the dispensing tray comprising an internal storage compartment adapted for storage of a plurality of units of a product to be dispensed and having a floor facing the moveable flap of the outer casing body, a dispensing window through which a stored unit of product is accessible when the dispensing tray is in the dispensing position, a first moveable flap in the floor of the dispensing tray opposite the dispensing window for deflection of a unit of product toward the dispensing window, a second moveable flap in the floor of the dispensing tray, and a stop adapted for engaging the outer casing body to prevent removal of the dispensing tray from the cavity of the outer casing body, wherein the second moveable flap comprises one or more recesses operatively positioned to engage the one or more protrusions when the dispensing tray is in the closed and locked position, such that depressing the flap will effect separation of the one or more protrusions from the one or more recesses and allow sliding movement of the dispensing tray within the outer casing body, and wherein the second moveable flap is configured to deflect away from the one or more protrusions when the moveable flap of the outer casing body is depressed.

In another preferred embodiment, the dispensing container of the invention comprises:

an outer casing body having a cavity therein and an open end, the outer casing body comprising a first surface comprising a moveable flap accessible from the exterior of the container, one or more protrusions projecting from the outer casing body into the cavity and positioned adjacent to the moveable flap, and at least one longitudinally extending ridge; and a dispensing tray adapted for sliding movement within the cavity of the outer casing body between a closed and locked position and a dispensing position, the dispensing tray comprising an internal storage compartment adapted for storage of a plurality of units of a product to be dispensed and having a floor facing the first surface of the outer casing body, the floor comprising at least one opening extending longitudinally in the direction of travel of the dispensing tray, wherein the at least one longitudinally extending ridge of the outer casing body is operatively positioned to move into engagement with the at least one opening of the storage compartment as the dispensing tray slides from the dispensing position to the closed and locked position, a dispensing window through which a stored unit of product is accessible when the dispensing tray is in the dispensing position, a dispensing chamber accessible through the dispensing window and adjacent to the storage compartment, a stop adapted for engaging the outer casing body to prevent removal of the dispensing tray from the cavity of the outer casing body, and a locking plate having one or more recesses therein, the one or more recesses of the locking plate operatively positioned to engage the one or more protrusions of the outer casing body, wherein the storage compartment is defined in part by a moveable retention tab having a first section extending substantially parallel to the floor of the storage compartment and a second section extending substantially perpendicular to the first section and forming a barrier between the storage compartment and the dispensing chamber, the retention tab operatively configured to deflect toward the floor of the storage compartment.

A surface of the outer casing body facing the first section of the retention tab can comprise a projection operatively positioned to engage the retention tab as the dispensing tray moves between the closed and locked position and the dispensing position such that the projection urges the retention tab toward the floor of the storage compartment. The first section of the retention tab can also include a channel positioned to engage the projection of the outer casing body, the channel having a sloped surface that engages the projection such that the deflecting force imposed on the retention tab by the projection changes as the dispensing tray travels between the closed and locked position and the dispensing position. Still further, the dispensing chamber can include a ramp positioned to engage a unit of product as the unit of product moves from the storage compartment to the dispensing chamber, the ramp being configured to elevate a unit of product positioned in the dispensing chamber to a height that prevents movement of the unit of product back into the storage compartment.

In another aspect of the invention, a method of dispensing a product from a container of the invention is provided. For example, one embodiment of the method includes steps such as depressing the moveable flap of the outer casing body such that a moveable flap of the dispensing tray deflects away from the one or more protrusions of the outer casing body and disengages the protrusions from the recesses of the moveable flap of the dispensing tray; while maintaining the moveable flap of the outer casing body in the depressed state, sliding the dispensing tray into a dispensing position wherein the dispensing window is accessible from the exterior of the container; depressing another moveable flap in the floor of the dispensing tray toward the interior of the storage compartment such that at least one unit of product is moved toward the dispensing window; and removing at least one unit of product from the storage compartment.

In another embodiment of the method of the invention, the method includes the steps of:

depressing the moveable flap of the outer casing body such that a locking plate deflects away from one or more protrusions of the outer casing body and disengages the protrusions from recesses in the locking plate;

while maintaining the moveable flap of the outer casing body in the depressed state, sliding the dispensing tray into a dispensing position wherein a dispensing window is accessible from the exterior of the container;

removing at least one unit of the product from the dispensing chamber, if present;

sliding the dispensing tray into the closed and locked position, one or more longitudinally extending ridges of the outer casing body engaging a unit of product adjacent to the floor of the storage compartment as the dispensing tray slides toward the closed and locked position and urging the unit of product under a retention tab and into a dispensing chamber, the retention tab deflecting toward the floor of the product storage compartment as the dispensing tray slides toward the closed and locked position such that only the unit of product engaged by the at least one longitudinally extending ridge is removed from the storage compartment;

depressing again the moveable flap of the outer casing body such that a locking plate deflects away from one or more protrusions of the outer casing body and disengages the protrusions from recesses in the locking plate;

while maintaining the moveable flap of the outer casing body in the depressed state, again sliding the dispensing tray into a dispensing position wherein the dispensing window is accessible from the exterior of the container; and removing at least one unit of product from the dispensing chamber.

BRIEF DESCRIPTION OF THE DRAWINGS

Figure 1:
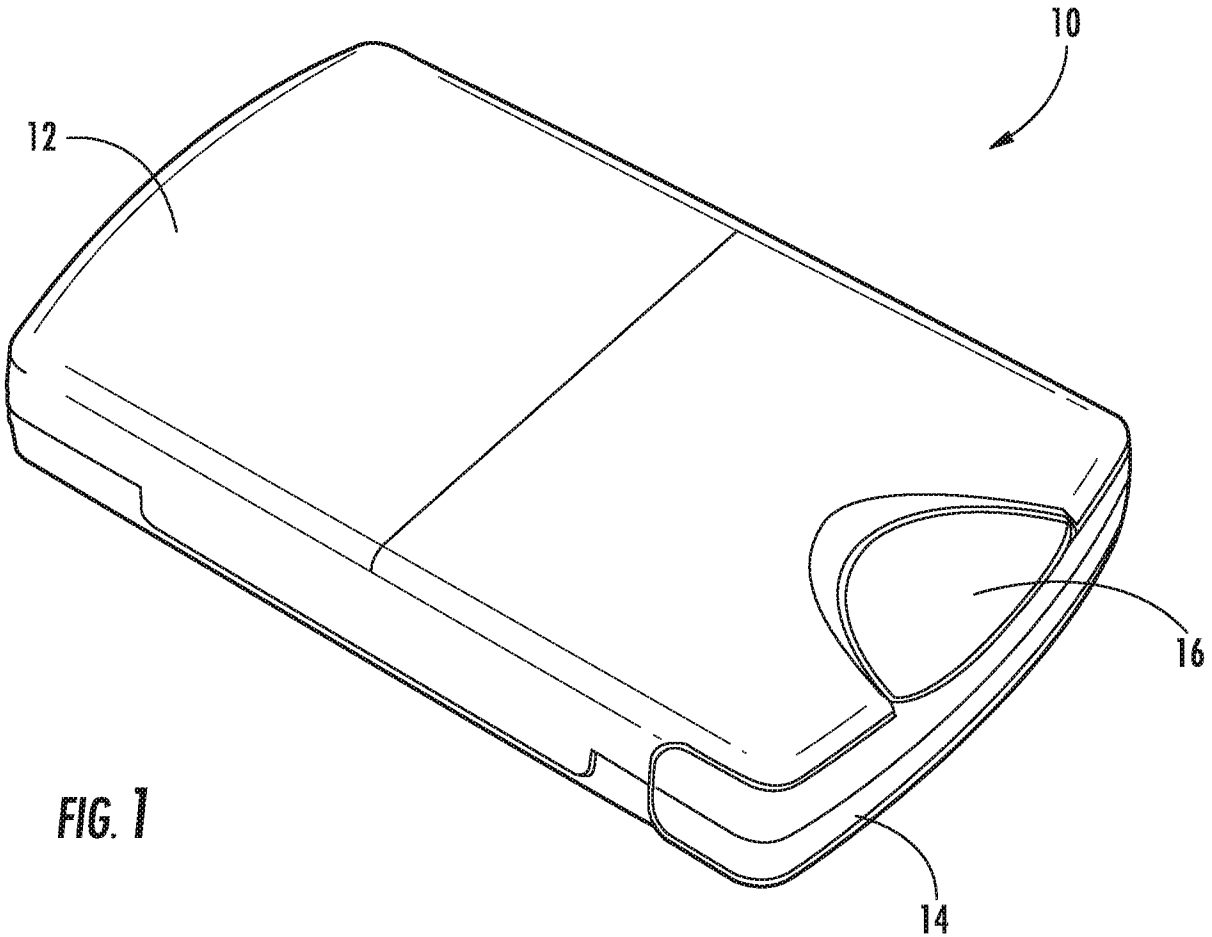
Figure 2:
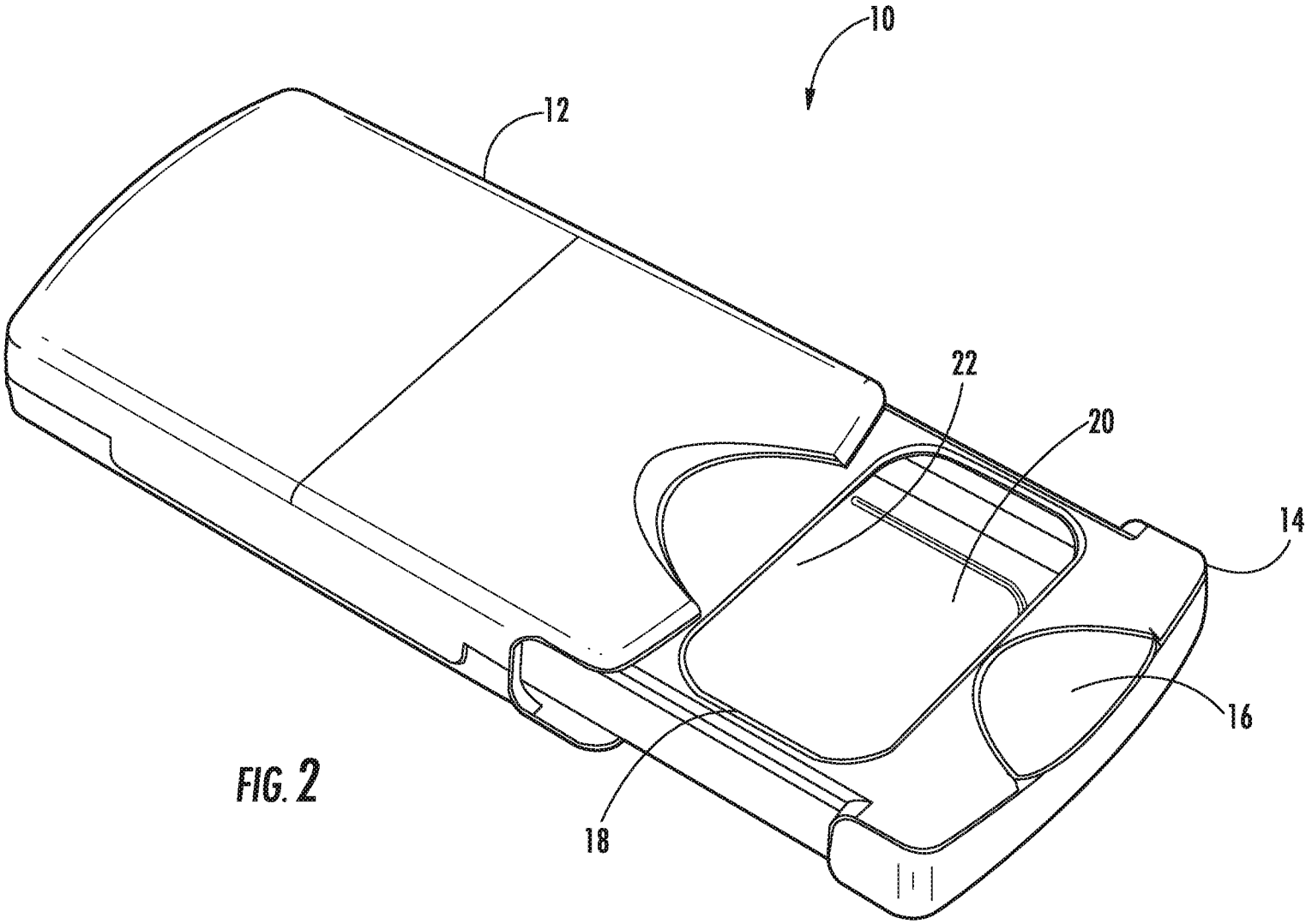
Figure 3:
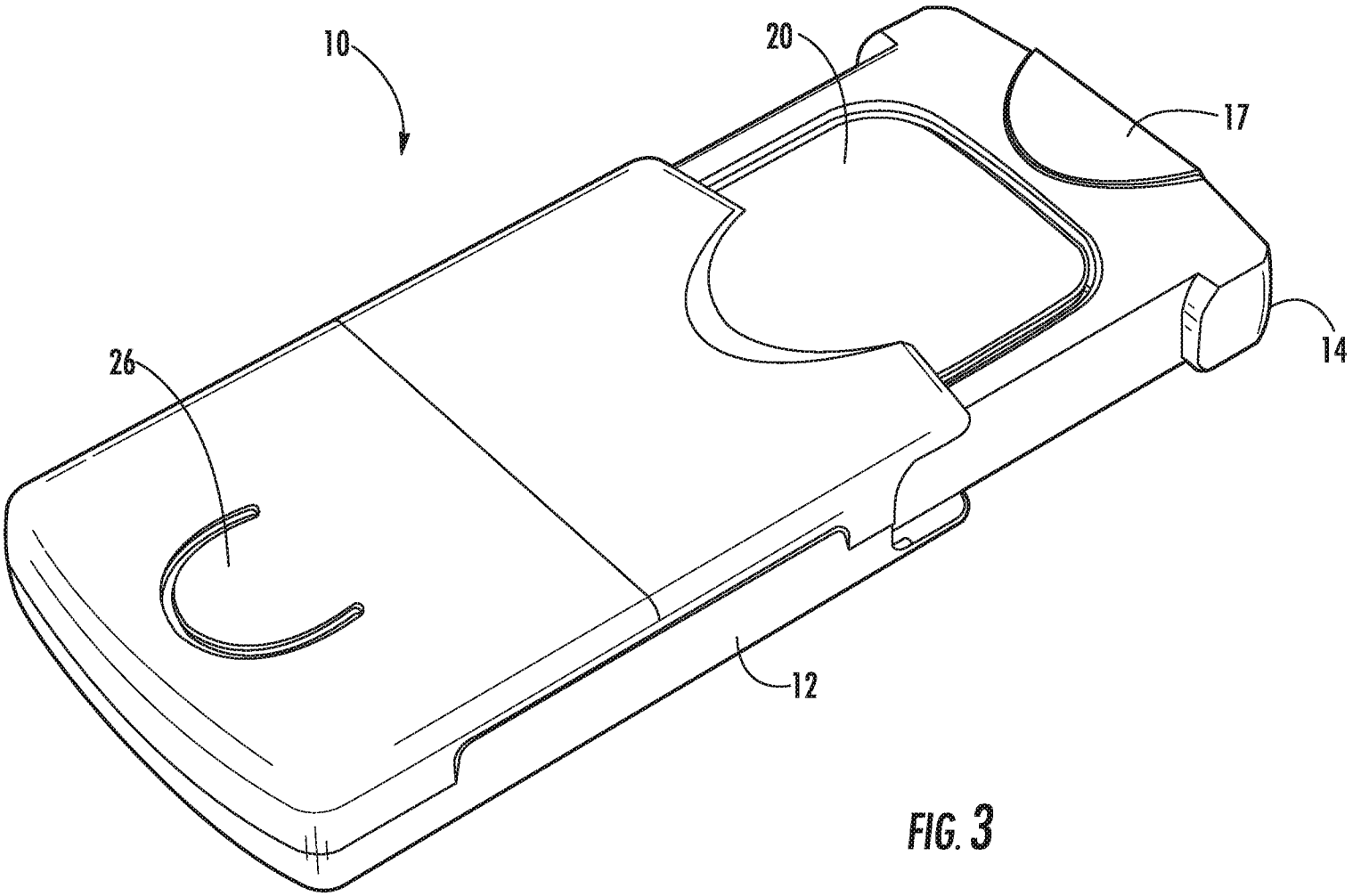
Figure 4:
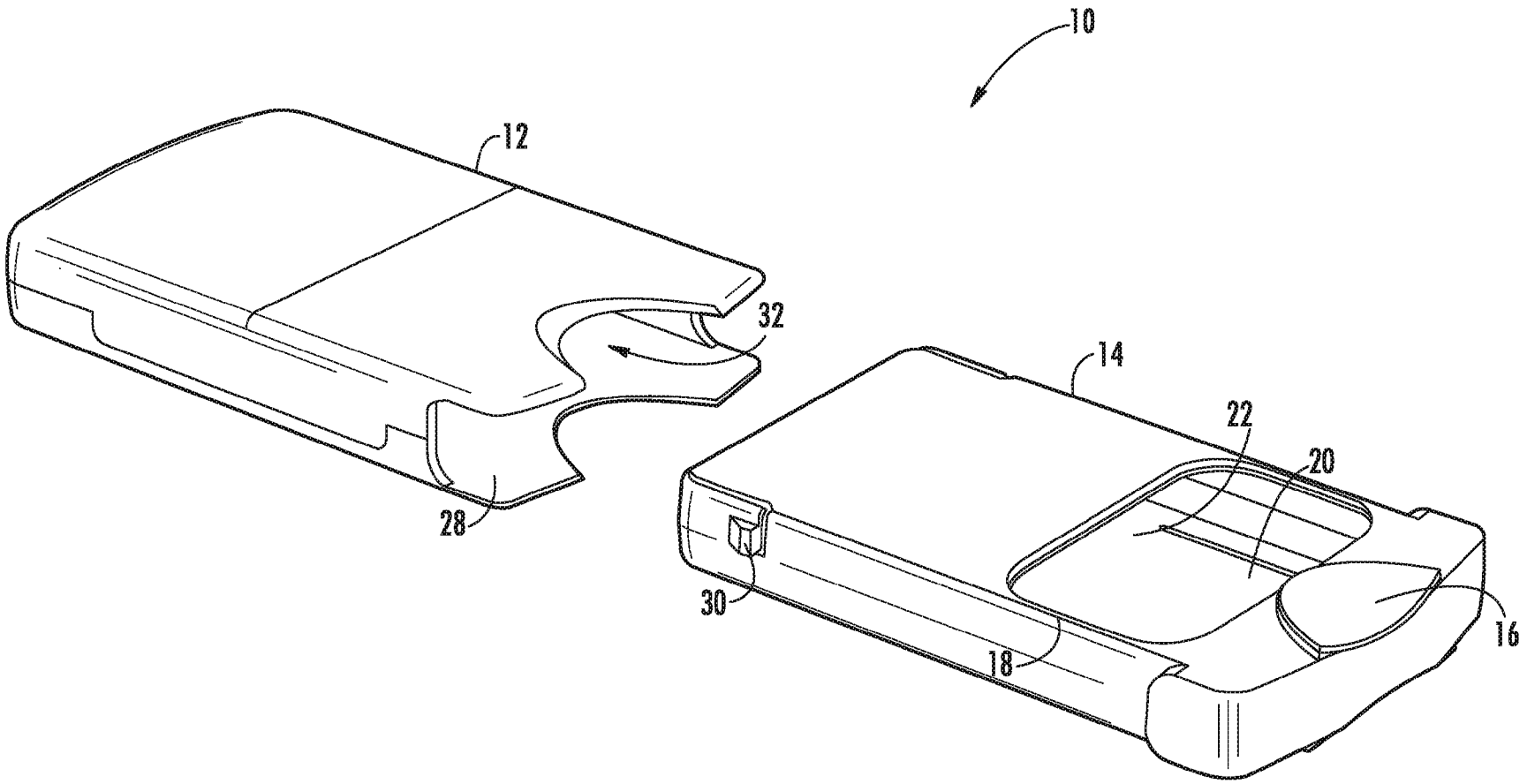
Figure 5:
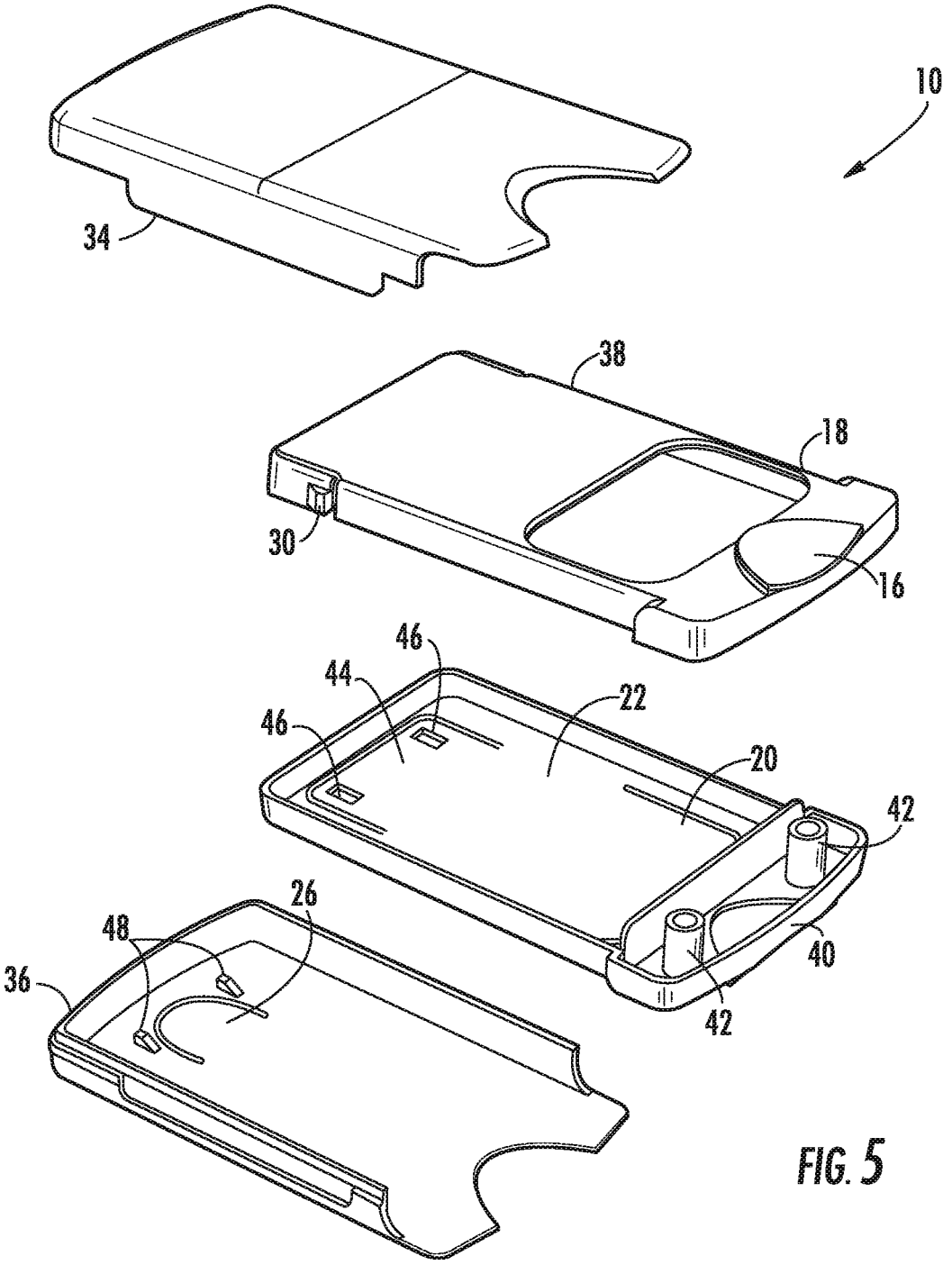
Figure 6:
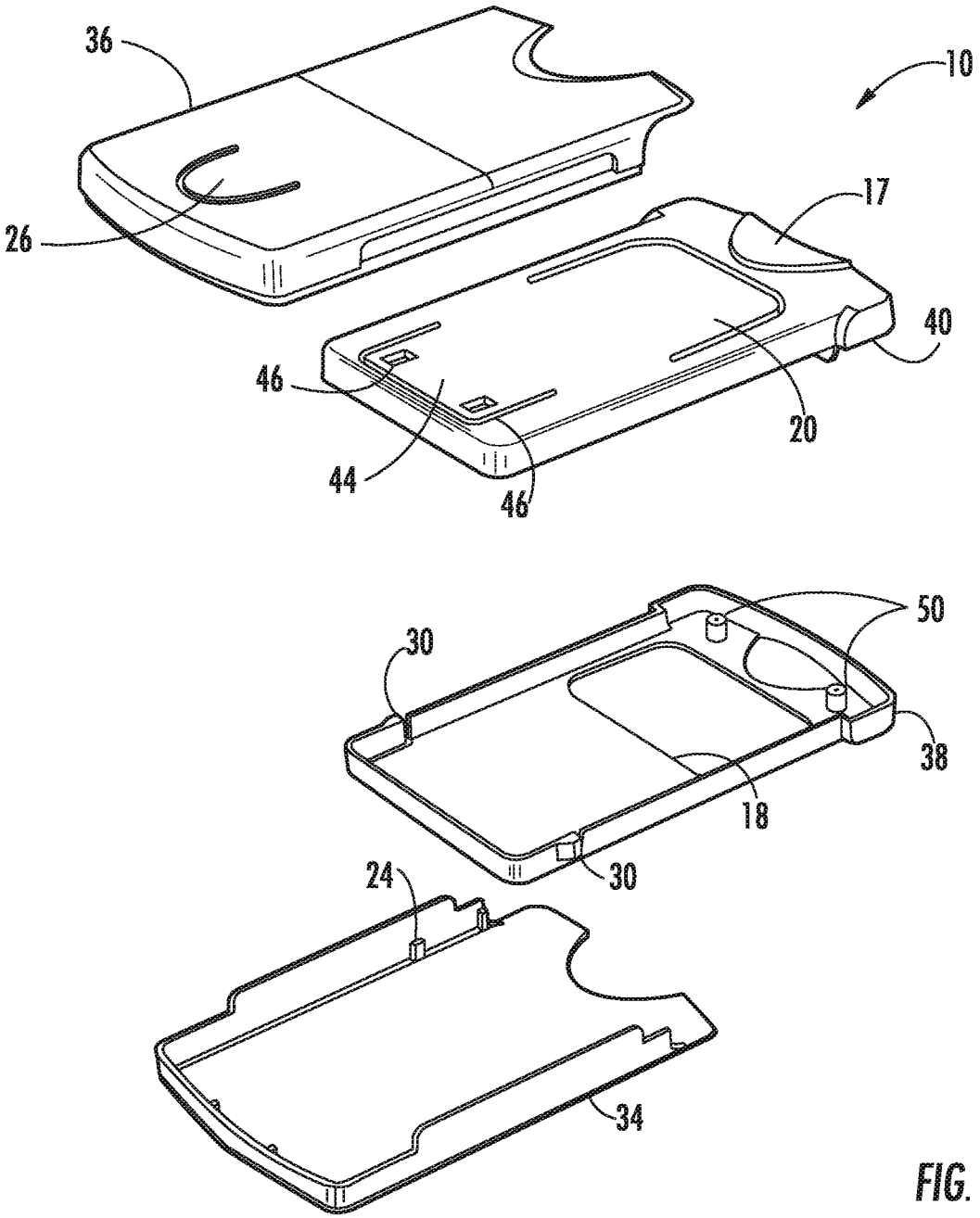
Figure 7:
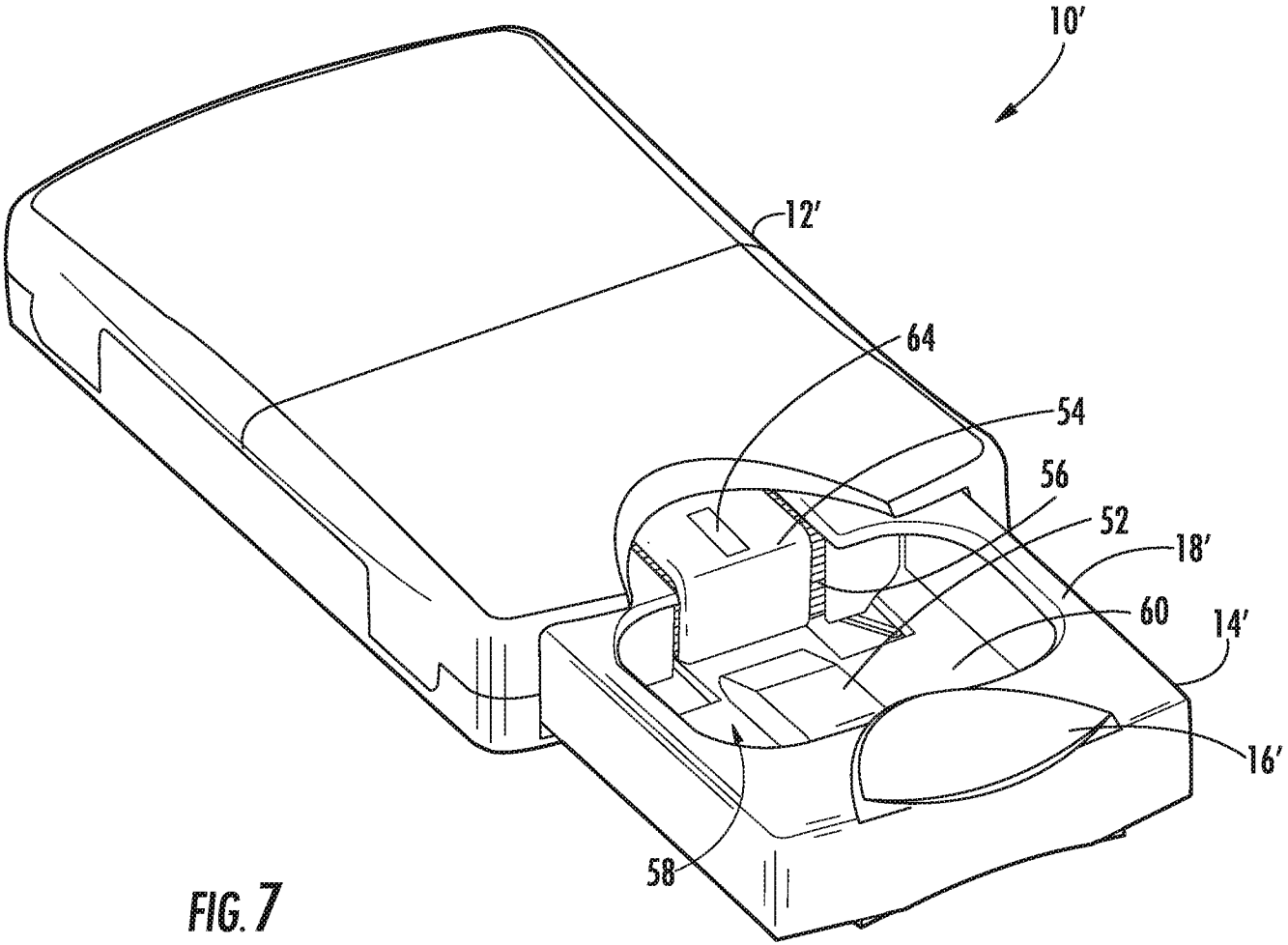
Figure 8:
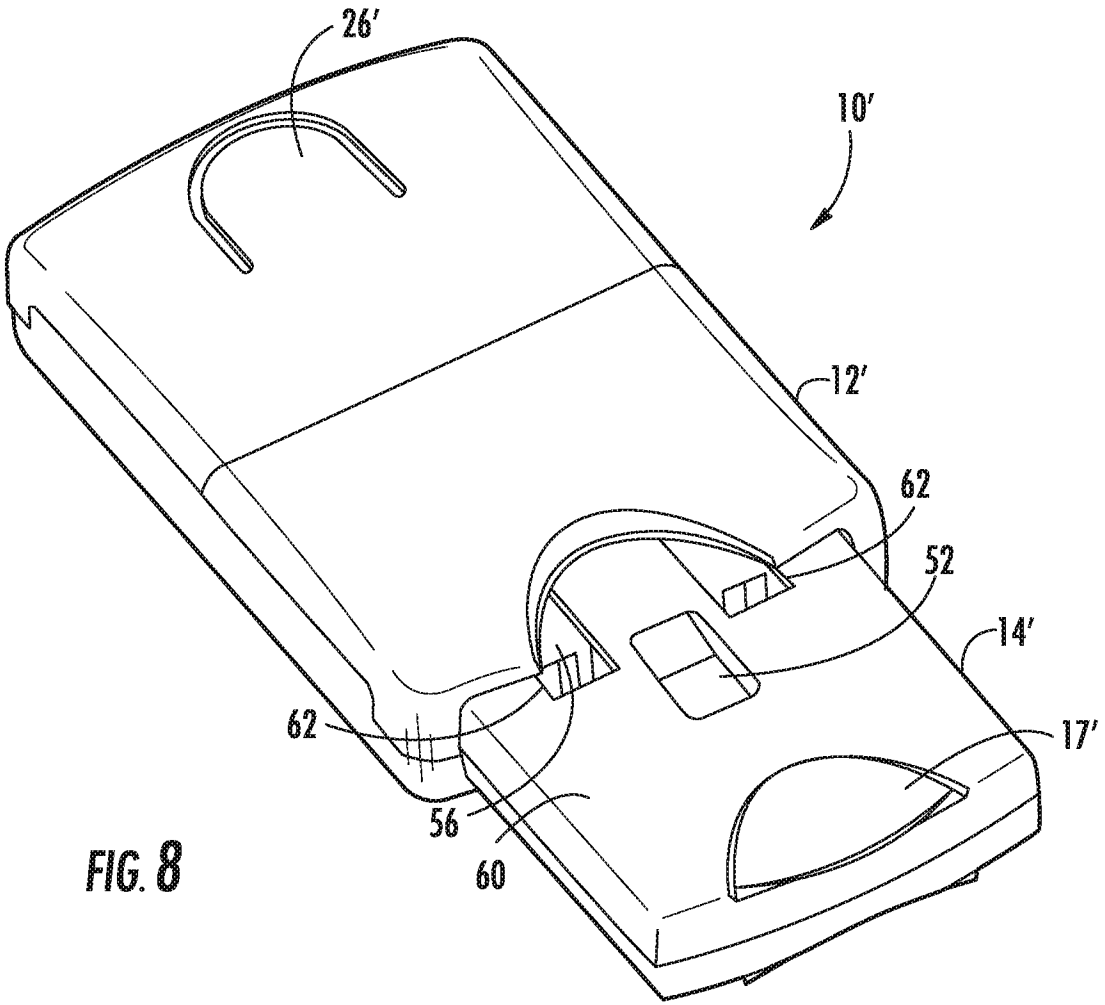
Figure 9:
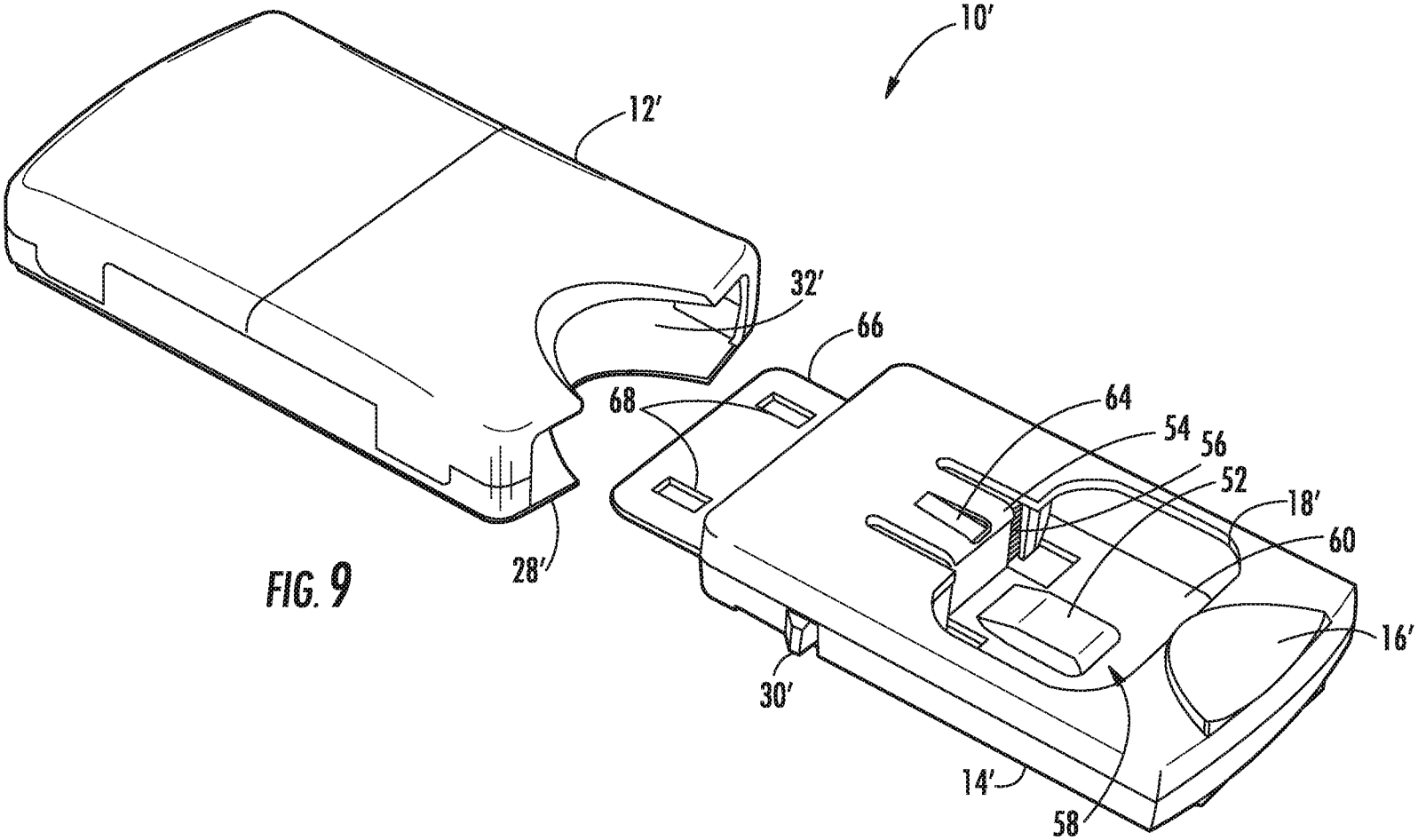
Figure 10:
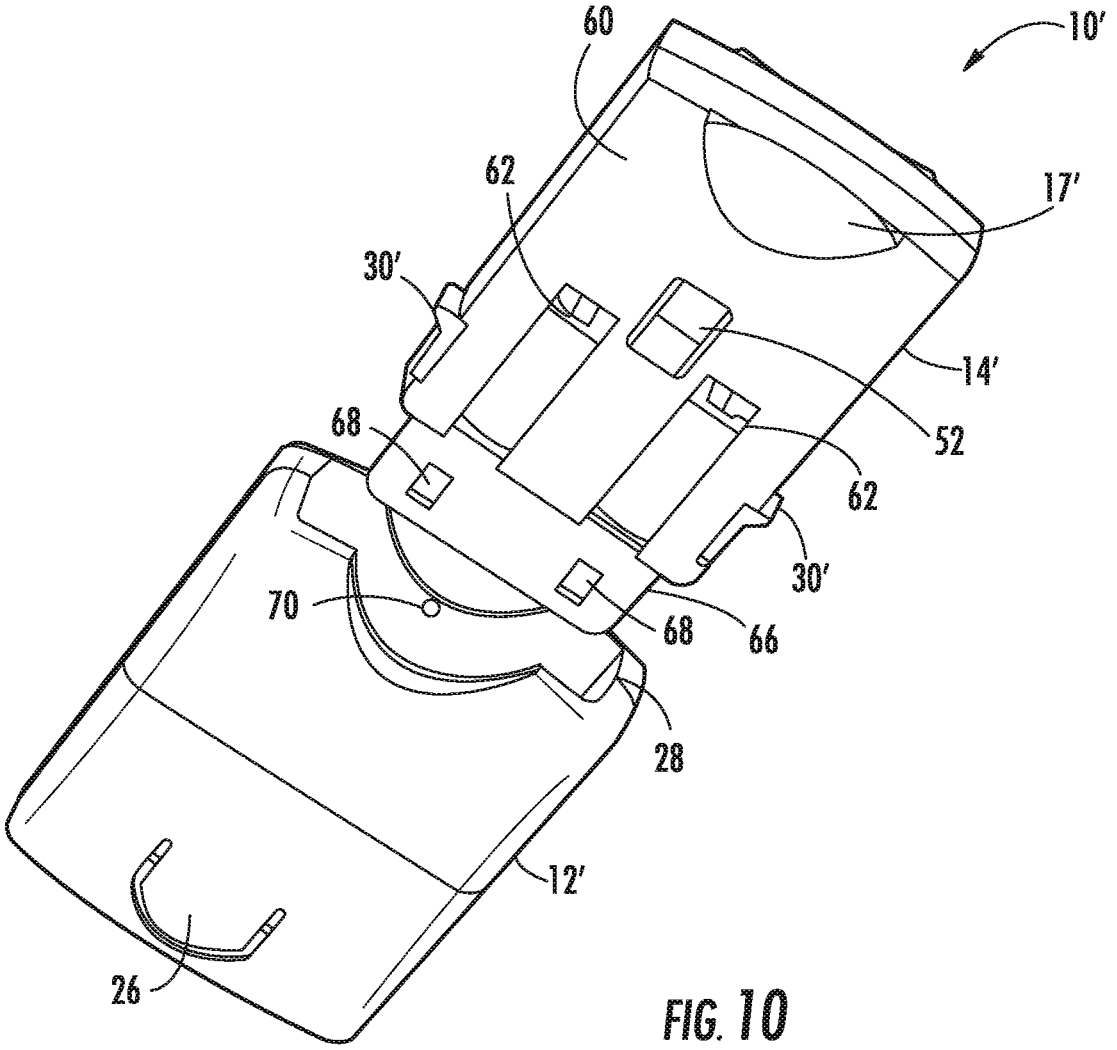
Figure 11:
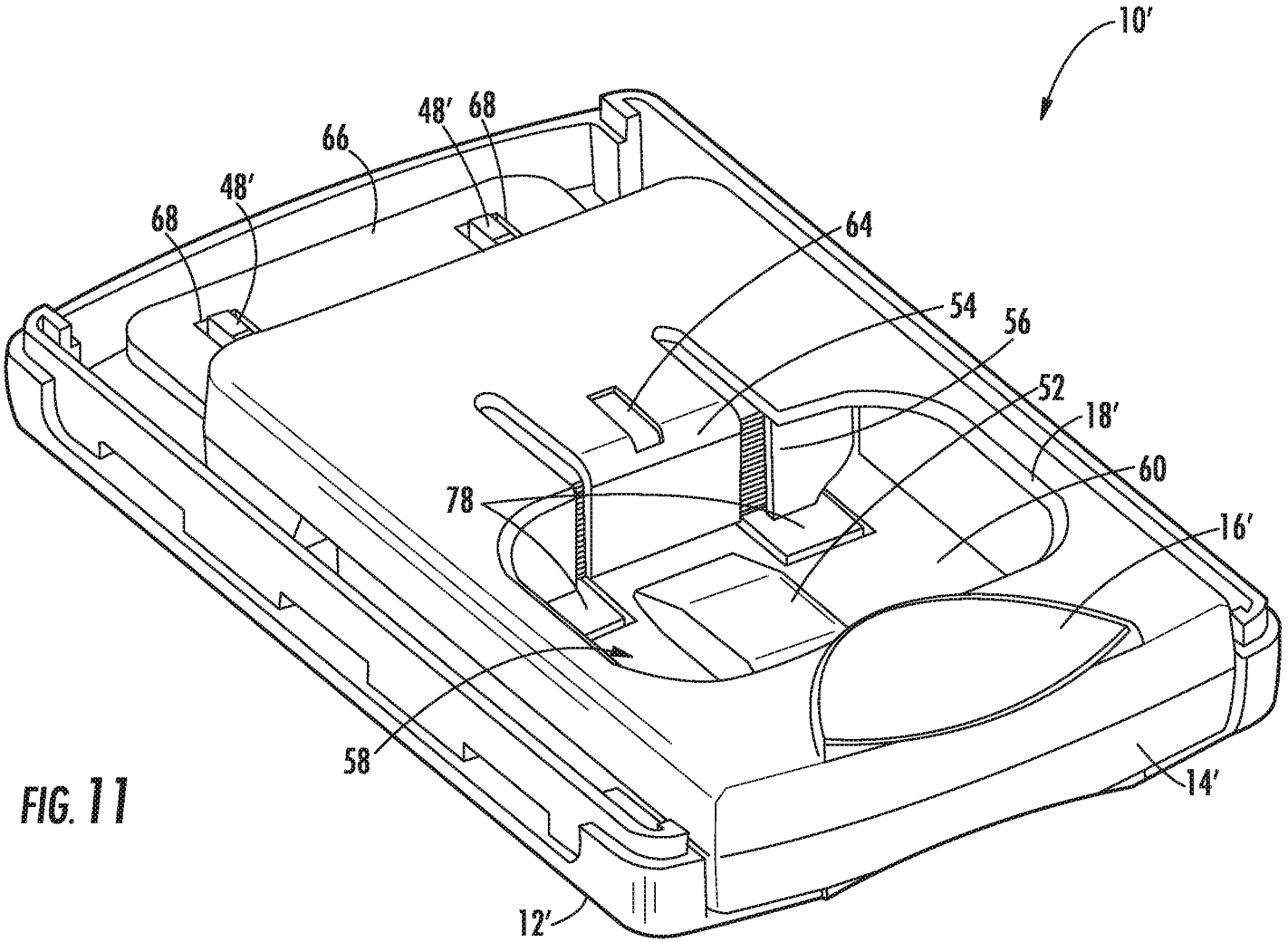
Figure 12:
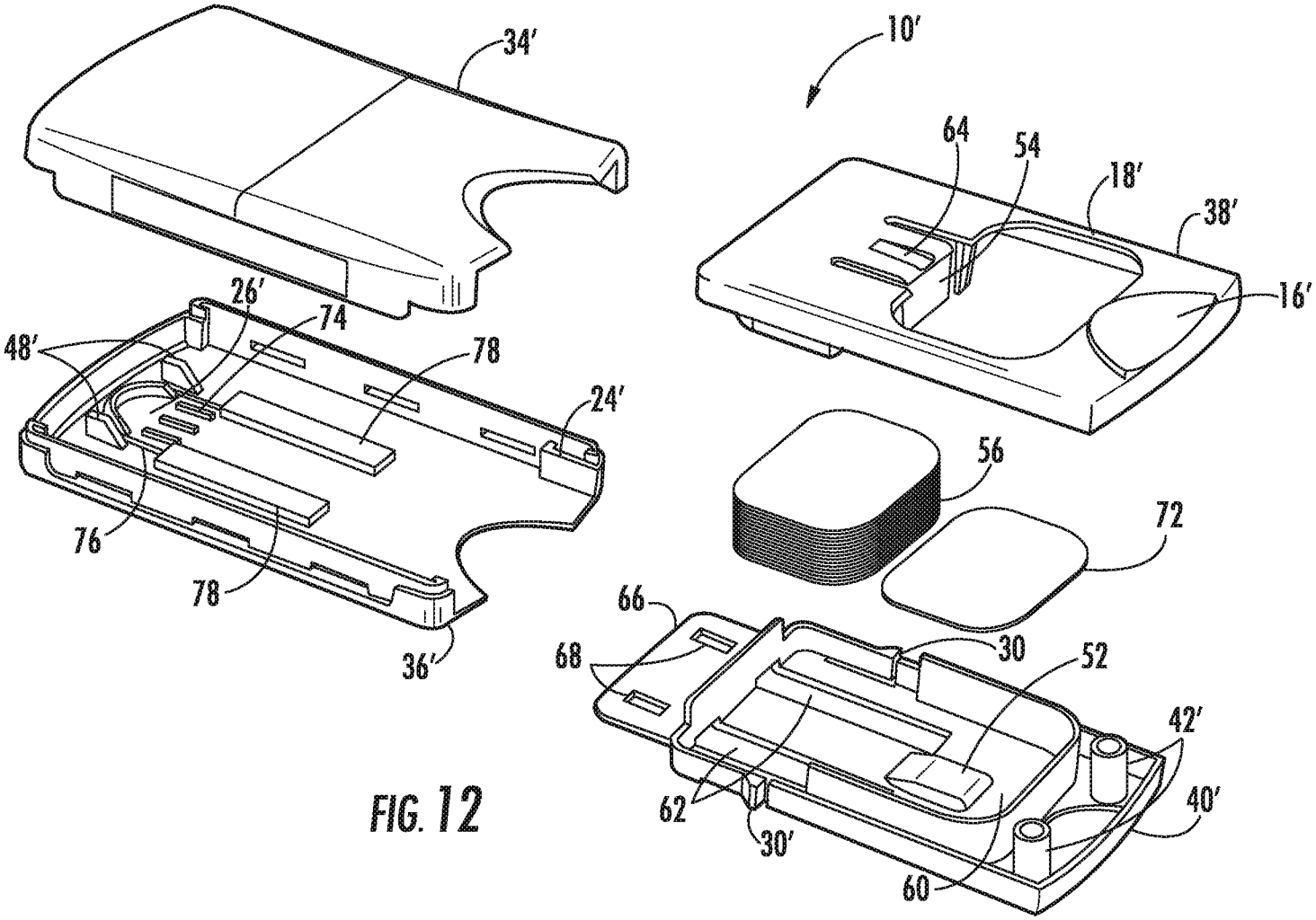
Figure 13:
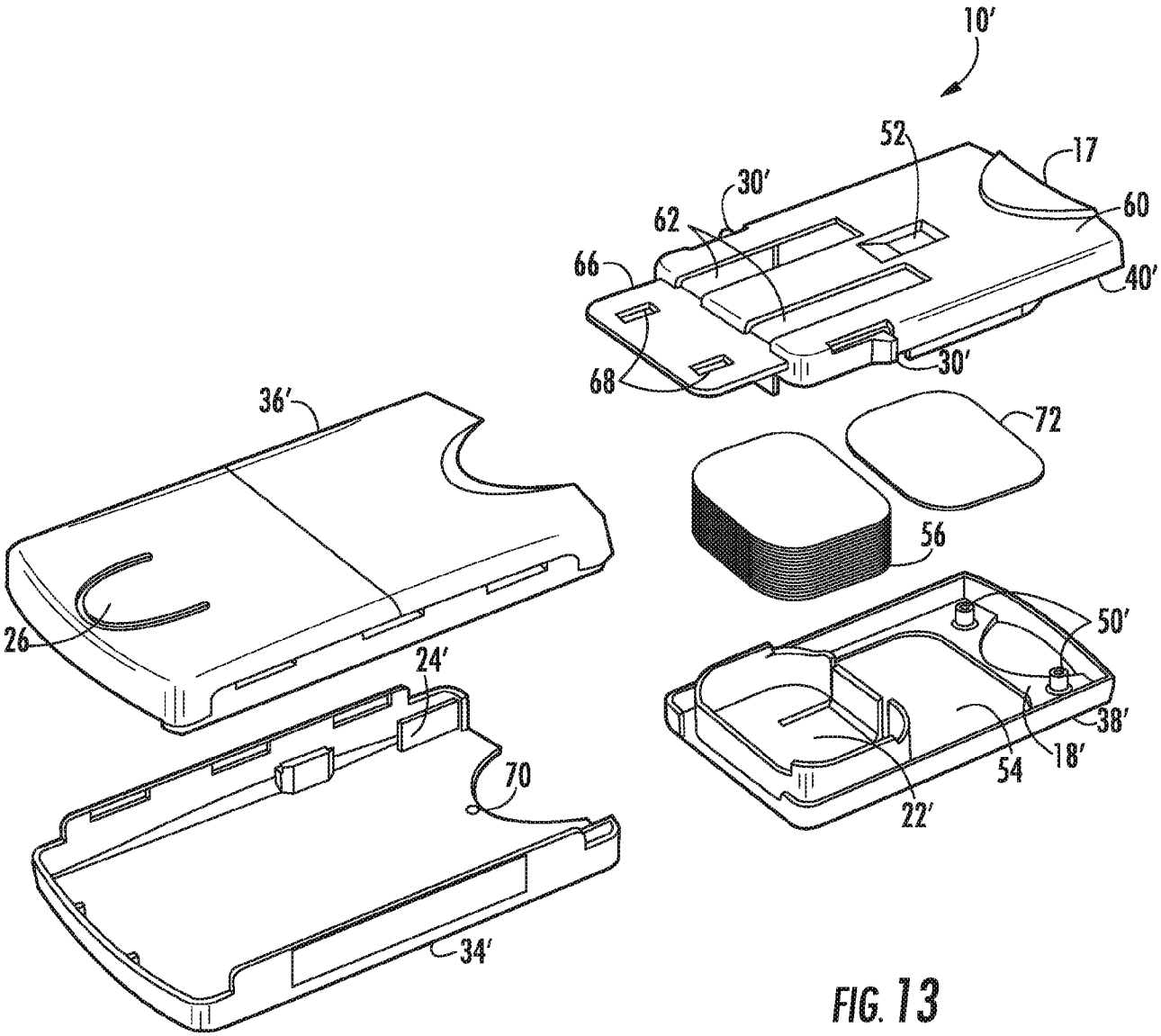

Having thus described the invention in general terms, reference will now be made to the accompanying drawings, which are not necessarily drawn to scale, and wherein:

FIG. 1 is a perspective view of a container embodiment of the invention in a closed position;

FIG. 2 is a perspective view of the container embodiment of FIG. 1 in an open, dispensing position and facing the dispensing window;

FIG. 3 is perspective view of the container embodiment of FIG. 1 in an open, dispensing position and facing the floor of the dispensing tray;

FIG. 4 is perspective view of the container embodiment of FIG. 1 with the dispensing tray removed from the outer casing body;

FIG. 5 is an exploded view of the container embodiment of FIG. 1 facing the dispensing window;

FIG. 6 is an exploded view of the container embodiment of FIG. 1 facing the floor of the dispensing tray;

FIG. 7 is a perspective view of a second container embodiment in a dispensing position and facing the dispensing window;

FIG. 8 is a perspective view of the container embodiment of FIG. 7 in a dispensing position and facing the floor of the dispensing tray;

FIG. 9 is a perspective view of the container embodiment of FIG. 7 with the dispensing tray removed from the outer casing body and facing the floor of the dispensing tray;

FIG. 10 is a perspective view of the container embodiment of FIG. 7 with the dispensing tray removed from the outer casing body and facing the dispensing window;

FIG. 11 is a perspective view of the container embodiment of FIG. 7 in a closed and locked position with the top of the outer casing body removed;

FIG. 12 is an exploded view of the container embodiment of FIG. 7 facing the dispensing window; and FIG. 13 is an exploded view of the container embodiment of FIG. 7 facing the floor of the dispensing tray.

DETAILED DESCRIPTION OF THE INVENTION

The present invention now will be described more fully hereinafter with reference to certain preferred embodiments. These embodiments are provided so that this disclosure will be thorough and complete, and will fully convey the scope of the invention to those skilled in the art. Indeed, the invention may be embodied in many different forms and should not be construed as limited to the embodiments set forth herein; rather, these embodiments are provided so that this disclosure will satisfy applicable legal requirements.

As used in the specification, and in the appended claims, the singular forms "a", "an", "the", include plural referents unless the context clearly dictates otherwise. Certain terms such as "floor," "top," or "bottom," are used herein solely as a means to describe the position of elements of the inventive containers relative to other elements of the containers and not relative to an external point of reference. Consequently, use of such terms does not convey any limitation as to the spatial position of the inventive containers relative to an external point of reference.

The container embodiments described in the present application can be used to store and dispense any solid products, but are particularly well-suited for products designed for oral consumption. Exemplary consumable products include pharmaceutical products such as pills and tablets, cigarettes and other smoking products, smokeless tobacco products, candies, mints, gums and other confectionary products, snacks, and the like.

Exemplary tobacco products include pelletized tobacco products (e.g., compressed or molded pellets produced from powdered or processed tobacco, such as those formed into the general shape of a coin, cylinder, bean, pellet, sphere, obloid, cube, bead, or the like), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, and the like.

Exemplary smokeless tobacco compositions that can be packaged in the containers of the invention are set forth in, for example, U.S. Pat. No. 1,376,586 to Schwartz; U.S. Pat. No. 3,368,567 to Speer; U.S. Pat. No. 4,513,756 to Pittman et al.; U.S. Pat. No. 4,606,357 to Dusek et al; U.S. Pat. No. 4,821,749 to Toft et al.; U.S. Pat. No. 5,167,244 to Kjerstad; U.S. Pat. No. 5,387,416 to White; U.S. Pat. No. 6,668,839 to Williams; U.S. 2005/0244521 to Strickland et al.; U.S. 2006/0191548 to Strickland et al.; U.S. 2007/0186942 to Strickland et al.; U.S. 2008/0029110 to Dube et al.; and U.S. 2008/0029116 to Robinson et al. Examples of tobacco-containing gum are set forth in U.S. Pat. No. 4,624,269 to Story et al.; U.S. Pat. No. 4,975,270 to Kehoe; and U.S. Pat. No. 4,802,498 to Ogren. Various manners or methods for packaging smokeless tobacco products are set forth in U.S. 2004/0217024 and U.S. 2006/0118589 to Arnarp et al.; WO 2005/016036 to Bjorkholm; WO 2006/034450 to Budd; WO 2007/017761 to Kutsch et al.; and WO 2007/067953 to Sheveley et al. All of the above-cited references are incorporated by reference herein in their entirety.

Smokeless tobacco compositions utilized as the product contained in the containers of the invention will often include such ingredients as tobacco (typically in particulate form), sweeteners, binders, colorants, pH adjusters, fillers, flavoring agents, disintegration aids, antioxidants, oral care additives, and preservatives. See, for example, U.S. 2007/0186941 to Holton et al., which is incorporated by reference herein in its entirety.

The size and shape of the product to be stored and dispensed can vary. Exemplary product shapes include pills, tablets, spheres, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. The dimensions of the product will often vary depending on its shape.

In one embodiment, the product is in the form of a flattened sheet or film. The sheet-like or film material typically has a shape that can be described as generally rectangular (optionally with rounded corners or edges), oval, triangular, or diamond-shaped. A generally rectangular sheet or film product will typically have a length in the range of about 20 to about 40 mm, more often about 25 to about 35 mm, and in some cases, between about 30 and about 35 mm (e.g., about 33 mm). The width of a generally rectangular sheet or film product will typically range from about 12 to about 28 mm, more often about 15 to about 25 mm, and in some cases, between about 18 and about 22 mm (e.g., about 20 mm). The thickness of the sheet or film product is typically within the range of about 0.05 to about 0.75 mm, more often about 0.1 to about 0.5 mm, and in some cases, between about 0.15 and about 0.25 mm. Sheet-shaped products are typically arranged in a stacked configuration within the storage compartment of the containers of the invention.

When the product is a smokeless tobacco composition, the sheet or film product can take a variety of forms, including films or sheets formed using tobacco reconstitution techniques known in the art. Alternatively, the sheet or film product can be in the form of so-called "edible films" or "orally dissolvable strips" that incorporate a tobacco component Exemplary sheet or film materials are set forth in U.S. Pat. No. 5,587,172 to Cherukuri et al.; U.S. Pat. No. 5,733,577 to Myers et al.; U.S. Pat. No. 5,869,098 to Misra et al.; U.S. Pat.

No. 5,871,781 to Myers et al.; U.S. Pat. No. 6,337,082 to Fuisz et al.; U.S. Pat. No. 6,596,298 to Leung et al.; U.S. Pat. No. 7,067,115 to Bess et al.; and U.S. Pat. No. 7,025,983 to Leung et al.; U.S. 2004/0241242 to Fuisz et al.; U.S. 2005/0244521 to Strickland et al.; U.S. 2006/0039953 to Leung et al.; U.S. 2006/0198873 to Chan et al.; U.S. 2006/0204559 to Bess et al.; U.S. 2007/0069416 to Yang et al.; U.S. 2008/0029110 to Dube et al.; U.S. Ser. No. 11/781,641 to Mua et al. (2007); and U.S. Ser. No. 12/014,525 to Robinson et al. (2008), all of which are incorporated by reference herein in their entirety.

The shape of the outer surface of the containers of the invention can vary. Although the container embodiments illustrated in the drawings have certain contours, containers with other exterior surface designs could also be used. For example, the sides or edges of the containers of the invention could be flattened, rounded, or beveled, and the various surfaces or edges of the container exterior could be concave or convex. Further, the opposing sides, ends, or edges of the container can be parallel or non-parallel such that the container becomes narrower in one or more dimensions.

The dimensions of the containers described herein can vary without departing from the invention. However, in preferred embodiments, the containers of the invention can be described as having a size suitable for handheld manipulation and operation. Exemplary dimensions for such handheld embodiments include lengths in the range of about 25 mm to about 200 mm, more typically about 50 mm to about 150 mm, and most often about 80 mm to about 120 mm. Exemplary widths include the range of about 10 mm to about 100 mm, more typically about 20 mm to about 80 mm, and most often about 30 mm to about 60 mm. As used herein, length and width refer to the major dimensions of the container that define the major plane of the container. Exemplary depths for handheld container embodiments of the invention range from about 5 mm to about 50 mm, more typically about 8 mm to about 30 mm, and most often about 10 mm to about 20 mm.

The number of solid product units stored in the containers of the invention can also vary, depending on the size of the container and the size of the product units. Typically, the number of stored product units will vary from about 5 to about 100, more typically about 10 to about 50, and most often about 10 to about 30 (e.g., about 10, about 15, about 20, or about 25).

The material of construction of the container can also vary. Exemplary materials include metal, wood, and synthetic plastic materials. Polymeric materials that can be extruded and/or molded into desired shapes are typically utilized, such as polyethylene, polystyrene, polyamide, and the like.

In certain embodiments, the containers of the invention combine several advantageous features, such as child-resistance and metered dispensing of a product. In particular, certain embodiments of the containers of the invention include a child-resistant locking mechanism that releasably locks the container in a closed and locked position. The locking mechanism can be released and a product dispensed using a series of manipulations including, for example, depressing a moveable flap on the outer casing body and sliding a dispensing tray from an open end of the outer casing body to expose the product to be dispensed. The containers of the invention provide, in certain embodiments, metered dispensing of the product by providing a mechanism for preventing movement of more than one unit of product into a dispensing chamber at one time.

Certain preferred embodiments of the invention are described herein as referring to metered dispensing of a single unit of product, which can be, for example, a single consumable unit of a smokeless tobacco product, a single consumable unit of a confectionary or snack product, or a single dosage unit of a pharmaceutical product. However, the invention encompasses embodiments where the product is dispensed in greater amounts, such as a plurality of units.

FIGS. 1-6 illustrate one embodiment of a dispensing container of the invention that is well-suited for storage and dispensing of a sheet-like product. In particular, the embodiment of FIGS. 1-6 is appropriate where metered dispensing of the product (e.g., dispensing of a single unit of product at one time) is unnecessary.

As shown, the container 10 comprises an outer casing body 12 and a dispensing tray 14, which is configured to slide within a cavity 32 formed in the outer casing body. The dispensing tray 14 extends from an open end 28 of the outer casing body 12 and may include optional, opposing indentations 16, 17 to facilitate grasping and sliding of the dispensing tray.

In this embodiment, the dispensing tray 14 slides from a closed and locked position as illustrated in FIG. 1 to a dispensing position as shown in FIG. 2. In the dispensing position, the storage compartment 22 of the dispensing tray 14 is accessible by the user through a dispensing window 18. Removal of one or more units of the stored product through dispensing window 18 is facilitated by the presence of a moveable flap 20 positioned in the floor of the dispensing tray 14 opposite the dispensing window. The moveable flap 20, shown in FIGS. 2-6, is configured to allow deflection of the flap by the user toward the interior of the storage compartment 22. In this manner, one or more units of the stored product can be deflected upward toward the dispensing window 18 so that the user can more readily grasp the product and remove it from the storage compartment 22. As shown, the moveable flap 20 can be formed by detaching the flap from the remainder of the floor of the dispensing tray 14 on three sides to enable flexing movement of the flap.

As shown in FIGS. 4-6, the dispensing tray 14 preferably includes at least one stop 30, and preferably a pair of stops positioned on opposing sides of the dispensing tray. The stops 30 are intended to prevent complete removal of the dispensing tray 14 from the cavity 32 of the outer casing body 12. Each stop 30 is designed to engage a blocking member 24 within the outer casing body 12, which is shown in FIG. 6. Abutting contact between the stops 30 and the blocking members 24 prevent further sliding travel of the dispensing tray 14 past the desired dispensing position.

The container 10 shown in FIGS. 1-6 also includes a child resistance or locking mechanism that includes a moveable flap 26 and one or more adjacent projections 48 provided in the floor of the outer casing body 12, and a second moveable flap 44 positioned in the floor of the storage compartment 22 of the dispensing tray 14. The second movable flap 44 of the dispensing tray 14 includes one or more recesses 46 positioned to engage the protrusions 48 when the dispensing tray is in the closed and locked position. In the illustrated embodiment, the locking mechanism includes a pair of protrusions 48 and a pair of recesses 46. The "recesses" can extend through the entire depth of the moveable flap 44 and form a hole (as shown) or extend only partway through. As with the moveable flap 20 of the dispensing tray 14, the second moveable flap 44 of the dispensing tray and the moveable flap 26 of the outer casing body 12 are designed to deflect or flex toward the interior of the container 10.

FIGS. 5 and 6 illustrate an exploded view of one embodiment of container 10. As illustrated, both the dispensing tray 14 and the outer casing body 12 can be constructed in multiple parts that are affixed together using any means known to the skilled artisan. Alternatively, both the dispensing tray 14 and the outer casing body 12 could be formed as a single unitary structure. The exemplified embodiment of container 10 includes a top portion 34 and a bottom portion 36 that are affixed together in order to form the outer casing body 12. Similarly, the dispensing tray 14 is formed by affixation between a top portion 38 and a bottom portion 40. In the exemplified embodiment, the dispensing tray 14 is formed by mating the connective elements 42 of the bottom portion 40 with corresponding connecting elements 50 of the top portion 38. In one preferred embodiment, the two portions 34, 36 of the outer casing body 12 can be adhered together using any suitable adhesive.

In operation, the container 10 of FIGS. 1-6 can be manipulated by a user to unlock the dispensing tray from its closed and locked position so that the dispensing tray moves in a sliding manner to an open and dispensing position. In the closed and locked position, the recesses 46 within the second moveable flap 44 of the dispensing tray 14 are engaged with the protrusions 48 adjacent to the moveable flap 26 of the outer casing body 12. The presence of the protrusions 48 within the recesses 46 prevents movement of the dispensing tray 14. The user digitally manipulates the moveable flap 26 of the outer casing body 12 by depressing the moveable flap toward the interior of the container 10. This deflection of the moveable flap 26 causes deflection of the second moveable flap 44 of the dispensing tray 14. Deflection of the moveable flap 44 of the dispensing tray 14 causes the recesses 46 to disengage the protrusions 48. While maintaining the locking mechanism in this depressed state, the user grasps indentations 16, 17 and slides the dispensing tray 14 toward the dispensing position. In the dispensing position, the dispensing window 18 is accessible from the exterior of the container and the user manipulates the moveable flap 20 of the dispensing tray 14 in order to deflect one or more units of product toward the dispensing window. Once the desired product is removed, the user slides the dispensing tray 14 back into the closed and locked position and the process is repeated as desired.

As shown in FIG. 5, the protrusions 48 preferably include a sloped surface facing the open end of the outer casing body 12, which facilitates movement of the dispensing tray 14 into the closed and locked position by allowing the moveable flap 44 of the dispensing tray to gradually deflect toward the interior of the storage compartment until the protrusions 48 are engaged in the recesses 46.

FIGS. 7-13 illustrate a second embodiment of the container of the invention. Elements of container embodiment 10' that are analogous to elements of container 10 of FIGS. 1-6 are labeled with the same element number and the prime symbol. The embodiment of FIGS. 7-13 has a number of features in common with the embodiment of FIGS. 1-6. For instance, the container 10' also includes an outer casing 12', a dispensing tray 14', a dispensing window 18', and indentations 16', 17' adapted for grasping the dispensing tray.

As shown in the exploded views of FIGS. 12 and 13, the outer casing body of 12' and the dispensing tray 14' can also be constructed in multiple pieces such as the top portion 34' and the bottom portion 36' of the outer casing body and the top portion 38' and the bottom portion 40' of the dispensing tray. However, as noted above, these elements of the container could also be constructed in a unitary manner. As also shown in FIGS. 12 and 13, various connective elements known in the art could be used to attach the multiple portions of the outer casing body 12' and the dispensing tray 14' such as the connective elements 42' and 50' of the illustrated embodiment.

The container embodiment 10' also includes stops 30' and blocking members 24' which function analogously to the elements of the same number in the embodiment shown in FIGS. 1-6. As shown in FIG. 12, the moveable flap 26' may further include one or more stiffening ribs 74 that are adapted to increase the force required to deflect the moveable flap toward the interior of the container. The precise number of stiffening ribs 74 will vary depending on the desired stiffness of the moveable flap 26', and the level of stiffness can be adjusted to appropriately balance the level of child resistance with ease of use for any particular application.

The container embodiment 10' also includes a locking mechanism that functions in a manner analogous to the locking mechanism set forth in FIGS. 1-6. In particular, the dispensing tray 14' includes a projecting locking plate 66 having one or more recesses 68 therein. The recesses 68 are operatively positioned to engage the protrusions 48' projecting into the interior of the outer casing body 12' when the container is in the closed and locked position. The projections 48' are adjacent to a moveable tab 26' formed in the outer casing body 12'.

The container embodiment 10' includes a storage compartment that is capable of housing a stack of sheet-like products 56 and an adjacent dispensing chamber 58. A dispensing pathway exists between the storage compartment and the adjacent dispensing chamber 58. The dispensing pathway is configured to allow metered dispensing of a single unit of product from the storage compartment to the dispensing chamber 58 along the floor 60 of the dispensing tray 14'. Internal walls within the dispensing tray 14' define the storage compartment and the adjacent dispensing chamber 58.

A retention tab 54 also defines, in part, the storage compartment configured to hold the stack of product 56 and provides a barrier between the storage compartment and the dispensing chamber 58. The retention tab 54 includes a first section positioned substantially parallel to the floor of the dispensing tray 14' such that the first section overlies the stack of product 56 contained in the storage compartment. The retention tab 54 also includes a second section connected to the first section that extends between the dispensing chamber 58 and the storage compartment and provides a barrier therebetween. The retention tab 54 is separated at least in part from the remainder of the sidewalls and top surface of the storage compartment holding the stack of product 56 such that the retention tab 54 can flex downward toward the floor 60 of the tray 14'.

In a preferred embodiment, the retention tab 54 further includes a channel 64 cut into the first section of the retention tab overlying the stacked product. The channel 64 is positioned to engage a projection 70 shown in FIGS. 10 and 13 of the outer casing body 12' as the dispensing tray 14' slides from a closed and locked position to a dispensing position and vice versa. The projection 70 imposes a downward force on the retention tab 54 during the sliding movement of the dispensing tray 14'. This downward force causes downward deflection of the retention tab 54 in a manner that aids retention of the stacked products 56 within the storage compartment and prevents more than the desired metered unit of product from moving into the dispensing chamber 58.

In one embodiment, the channel 64 formed in the retention tab 54 has a sloped surface such that the downward force exerted by the projection 70 changes as the dispensing tray slides between the closed and locked position and the dispensing position. For example, the sloped surface can slope downward (i.e., sloping toward the floor 60 of the dispensing tray 14') from a higher point at the end of the channel 64 furthest from the dispensing chamber 58 to a lower point at the end of the channel closest to the dispensing chamber. In this manner, the force applied by the projection 70 on the retention tab 54 will decrease as the projection travels toward the end of the channel 64 closest to the dispensing chamber 58.

The dispensing chamber 58 includes a ramp element 52 in the floor thereof. The ramp provides a sloped surface positioned to engage a unit of product moving from the storage compartment into the dispensing chamber 58. The ramp provides a higher surface above the floor of the tray 60 upon which the dispensed product will rest within the dispensing chamber 58. The increase in height of the dispensed product aids in preventing movement of the dispensed product back underneath the retention tab 54 and into the storage compartment after dispensing.

The floor 60 of the dispensing tray 14' further includes one or more openings 62 that extend longitudinally in the direction of travel of the dispensing tray. The outer casing body 12' includes corresponding longitudinally extending ridges 78 projecting into the interior of the outer casing body and positioned to engage the openings 62 in the floor of the dispensing tray 14' as the dispensing tray moves from the dispensing position into the closed and locked position. The interaction between the ridges 78 and the openings 62 results in movement of a unit of product into the dispensing chamber 58 as the container moves from the dispensing position into the closed and locked position. The ridges are advantageously provided with a surface having a relatively high coefficient of friction. For example, the surface of the ridges 78 can be mechanically roughened in order to enhance frictional contact between the ridges and a unit of product to be dispensed. Alternatively, the ridges 78 could be constructed of an elastomeric material or a plastomer (e.g., metallocene polyethylenes). In a preferred embodiment, the container 10' includes a pair of openings 62 and a pair of corresponding ridges 78.

In operation, the user of the container 10' deflects the moveable flap 26' toward the interior of the container in order to disengage the recesses 68 from the projections 48'. While the moveable flap 26' is in the depressed state, the user slides the dispensing tray 14' from its closed and locked position to the dispensing position wherein a unit of product 72 is accessible through dispensing window 18'.

Thereafter, the user slides the dispensing tray 14' back toward the closed and locked position. During this movement, the channel 64 of the retention tab 54 engages the projection 70 on the outer casing body 12' and causes a downward deflection of the retention tab. Concurrently, the longitudinally extending ridges 78 of the outer casing body 12' engage the openings 62 in the floor 60 of the tray 14'. As the ridges 78 engage the openings 62, the ridges contact the lowest unit of product within the stack 56 of products within the storage compartment, thereby urging the lowest unit of product to move from the storage compartment into the dispensing chamber 58. This may cause the sheet-like product that is being urged into the dispensing chamber 58 to buckle slightly at the leading edge of the product closest to the dispensing chamber before the leading edge of the product unit begins sliding underneath the retention tab 54 and into the dispensing chamber 58. In embodiments of the container having a channel 64 with a sloped surface, the projection 70 will gradually cause less downward deflection of the retention tab 54 as the dispensing tray 14' travels toward the closed and locked position. This can facilitate movement of the unit to be dispensed from the storage compartment to the dispensing chamber 58.

As the unit of product to be dispensed moves into the dispensing chamber 58, it will encounter the ramp 52, which raises the height of the product unit as it enters the dispensing chamber. Once the container embodiment 10' has reached the closed and locked position such that the recesses 68 on the locking plate 66 are once again engaged with the protrusion 48' of the outer casing body 12', the unit 72 to be dispensed is fully contained within the dispensing chamber 58.

Once the user desires to remove this unit of product from the dispensing chamber 58, the user again deflects the moveable flap 26' in order to unlock the container and slide the dispensing tray 14' into its dispensing position. As the dispensing tray 14' moves into the dispensing position, the projection 70 of the outer casing body 12' again engages the channel 64 of the retention tab 54 and causes the retention tab to deflect downward as the dispensing tray slides into the dispensing position, thereby preventing movement of the dispensed unit 72 back into the storage compartment during the sliding movement of the dispensing tray.

As part of the final packaging process, once the dispensing containers of the invention are filled with the desired product, the containers can be over-wrapped or over-sealed with a film material, or shrink-wrapped with such a material. The outer packaging material useful in accordance with the present invention can vary. Typically, the selection of the packaging material is dependent upon factors such as aesthetics, transparency, comfort of handling, desired barrier properties (e.g., so as to provide protection from exposure to oxygen or radiation, or so as to provide protection from loss of moisture), or the like. The packaging material preferably has the form of a film, such as a laminated film (e.g., a co-extruded laminated film). Representative materials that can be used to provide components or layers of film materials or laminated films include polyvinyl chloride, ethylene vinyl acetate co-polymer, oriented polypropylene, linear low density polyethylene, polyvinylidene dichloride, polyester terephthalate, ethylene methacrylic acid co-polymer, metallacene linear low density polyethylene, cellulosic materials (e.g., cellophane), and the like. Exemplary packaging materials can be plastic/metal films, plastic/metal films that are paper coated, plastic laminate films, or the like. U.S. 2008/0029116 to Robinson et al. discloses examples of suitable packaging materials.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dispensing container, comprising:

an outer casing body having a cavity therein and an open end;

a dispensing tray adapted for sliding movement within the cavity of the outer casing body between a closed and locked position and a dispensing position, the dispensing tray comprising an internal storage compartment adapted for storage of a plurality of units of a product to be dispensed, a dispensing window through which a stored unit of product is accessible when the dispensing tray is in the dispensing position, and a stop adapted for engaging the outer casing body to prevent removal of the dispensing tray from the cavity of the outer casing body;

a locking mechanism adapted for releasably locking the dispensing tray in the closed and locked position, the locking mechanism comprising one or more protrusions projecting from the outer casing body into the cavity and positioned adjacent to a moveable first flap formed in the outer casing body, and one or more recesses carried by the dispensing tray and operatively positioned to engage the one or more protrusions when the dispensing tray is in the closed and locked position, such that depressing the moveable first flap will effect separation of the one or more protrusions from the one or more recesses and allow sliding movement of the dispensing tray within the outer casing body; and a moveable second flap in a surface of the dispensing tray opposite the dispensing window for deflection of a unit of product toward the dispensing window, wherein the moveable second flap is partially surrounded by a hole through the dispensing tray such that the moveable second flap is partially detached from the dispensing tray.

2. The dispensing container of claim 1, wherein the container is configured to provide metered dispensing of a single unit of stored product.

3. The dispensing container of claim 1, wherein locking mechanism comprises two protrusions, one protrusion positioned on either side of the moveable first flap, and two recesses formed in the dispensing tray adapted to engage the two protrusions.

4. The dispensing container of claim 1, wherein the protrusions of the outer casing body comprise a slanted surface positioned to engage the dispensing tray as the dispensing tray moves toward the closed and locked position.

5. The dispensing container of claim 1, wherein the moveable first flap comprises one or more ribs projecting into the cavity of the outer casing body.

6. The dispensing container of claim 1, wherein the storage compartment comprises a plurality of products.

7. The dispensing container of claim 1, wherein the product is characterized by a shape selected from the group consisting of pill, tablet, sphere, sheet, coin, cube, bead, ovoid, obloid, bean, stick, and rod.

8. The dispensing container of claim 1, wherein the product is selected from the group consisting of pharmaceutical products, smoking products, smokeless tobacco products, snack products, and confectionary products.

9. The dispensing container of claim 1, wherein the product is a smokeless tobacco product.

10. The dispensing container of claim 1, wherein the product is selected from the group consisting of pharmaceutical products, candies, mints, and gums.

11. The dispensing container of claim 1, wherein the storage compartment is configured to hold a plurality of sheet-shaped products in a stacked arrangement.

12. A dispensing container, comprising:

an outer casing body having a cavity therein and an open end, the outer casing body comprising a moveable flap accessible from the exterior of the container and one or more protrusions projecting from the outer casing body into the cavity and positioned adjacent to the moveable flap; and a dispensing tray adapted for sliding movement within the cavity of the outer casing body between a closed and locked position and a dispensing position, the dispensing tray comprising an internal storage compartment adapted for storage of a plurality of units of a product to be dispensed and having a floor facing the moveable flap of the outer casing body, a dispensing window through which a stored unit of product is accessible when the dispensing tray is in the dispensing position, a first moveable flap in the floor of the dispensing tray opposite the dispensing window for deflection of a unit of product toward the dispensing window wherein the first moveable flap is partially surrounded by a hole through the dispensing tray such that the first moveable flap is partially detached from the dispensing tray, a second moveable flap in the floor of the dispensing tray, and a stop adapted for engaging the outer casing body to prevent removal of the dispensing tray from the cavity of the outer casing body, wherein the second moveable flap comprises one or more recesses operatively positioned to engage the one or more protrusions when the dispensing tray is in the closed and locked position, such that depressing the moveable flap of the outer casing body will effect separation of the one or more protrusions from the one or more recesses and allow sliding movement of the dispensing tray within the outer casing body, and wherein the second moveable flap is configured to deflect away from the one or more protrusions when the moveable flap of the outer casing body is depressed.

13. The dispensing container of claim 12, wherein the outer casing body comprises two protrusions, one protrusion positioned on either side of the moveable flap of the outer casing body, and wherein the dispensing tray comprises two recesses formed in the second moveable flap of the dispensing tray adapted to engage the two protrusions.

14. The dispensing container of claim 12, wherein the protrusions of the outer casing body comprise a slanted surface positioned to engage the dispensing tray as the dispensing tray moves toward the closed and locked position.

15. The dispensing container of claim 12, wherein the moveable flap of the outer casing body comprises one or more ribs projecting into the cavity of the outer casing body.

16. The dispensing container of claim 12, wherein the product is selected from the group consisting of pharmaceutical products, smoking products, smokeless tobacco products, snack products, and confectionary products.

17. The dispensing container of claim 12, wherein the product is a smokeless tobacco product.

18. The dispensing container of claim 12, wherein the product is selected from the group consisting of pharmaceutical products, candies, mints, and gums.

19. The dispensing container of claim 12, wherein the storage compartment is configured to hold a plurality of sheet-shaped products in a stacked arrangement.

20. A method of dispensing a product from a container, comprising:

providing a container in a closed and locked position, the container comprising:

an outer casing body having a cavity therein and an open end, the outer casing body comprising a moveable flap accessible from the exterior of the container and one or more protrusions projecting from the outer casing body into the cavity and positioned adjacent to the moveable flap; and a dispensing tray adapted for sliding movement within the cavity of the outer casing body between a closed and locked position and a dispensing position, the dispensing tray comprising an internal storage compartment adapted for storage of a plurality of units of a product to be dispensed and having a floor facing the moveable flap of the outer casing body, a dispensing window through which a stored unit of product is accessible when the dispensing tray is in the dispensing position, a first moveable flap in the floor of the dispensing tray opposite the dispensing window for deflection of a unit of product toward the dispensing window wherein the first moveable flap is partially surrounded by a hole through the dispensing tray such that the first moveable flap is partially detached from the dispensing tray, and a second moveable flap in the floor of the dispensing tray, wherein the second moveable flap comprises one or more recesses engaged with the one or more protrusions of the outer casing body;

depressing the moveable flap of the outer casing body such that the second moveable flap of the dispensing tray deflects away from the one or more protrusions of the outer casing body and disengages the protrusions from the recesses of the second moveable flap;

while maintaining the moveable flap of the outer casing body in the depressed state, sliding the dispensing tray into a dispensing position wherein the dispensing window is accessible from the exterior of the container;

depressing the first moveable flap in the floor of the dispensing tray toward the interior of the storage compartment such that at least one unit of product is moved toward the dispensing window; and removing at least one unit of product from the storage compartment.

21. The method of claim 20, wherein the product is selected from the group consisting of pharmaceutical products, smoking products, smokeless tobacco products, snack products, and confectionary products.

22. The method of claim 20, wherein the product is a smokeless tobacco pro duct.

23. The method of claim 20, wherein the product is selected from the group consisting of pharmaceutical products, candies, mints, and gums.

24. The method of claim 20, wherein the storage compartment is configured to hold a plurality of sheet-shaped products in a stacked arrangement.

* * * * *